US005711241A

United States Patent [19]

Dyer

[11] Patent Number: 5,711,241

[45] Date of Patent: Jan. 27, 1998

[54] TROLLING PLATE

[76] Inventor: William B. Dyer, 3359 Taylor Rd., Central Point, Oreg. 97502

[21] Appl. No.: 724,003

[22] Filed: Sep. 30, 1996

Related U.S. Application Data

[63] Continuation-in-part of Ser. No. 630,512, Apr. 10, 1996, abandoned.

[51] Int. Cl.[6] ..... B63H 25/48

[52] U.S. Cl. ..... 114/145 A

[58] Field of Search ..... 114/145 R, 145 A; 74/527; 267/175, 177

[56] References Cited

U.S. PATENT DOCUMENTS

| | | | |
|---|---|---|---|
| 2,245,303 | 6/1941 | Shane | 267/175 |
| 2,654,336 | 10/1953 | Katzung et al. | 114/145 A |
| 3,965,838 | 6/1976 | Uht | 114/145 A |
| 5,239,891 | 8/1993 | Stocker | 74/513 |

*Primary Examiner*—Sherman Basinger
*Attorney, Agent, or Firm*—James D. Givnan, Jr.

[57] ABSTRACT

A trolling plate assembly includes a plate structure pivotally carried on a supporting bracket on a propulsion unit. The plate structure is spring biased toward a downward or deployed position. Ears on the plate structure provide tracks on which followers are entrained with the followers seating in recesses at the end of each track to retain the plate structure horizontal. The rollers are biased into track and into recess engagement. A control permits the user to disengage the rollers from the recesses to allow downward deployment of the plate structure. A modified trolling plate includes a pair of adjustably biased rollers each for rolling contact with a trolling plate ear for seating in multiple recesses therein. Each recess is associated with a different plate position.

10 Claims, 2 Drawing Sheets

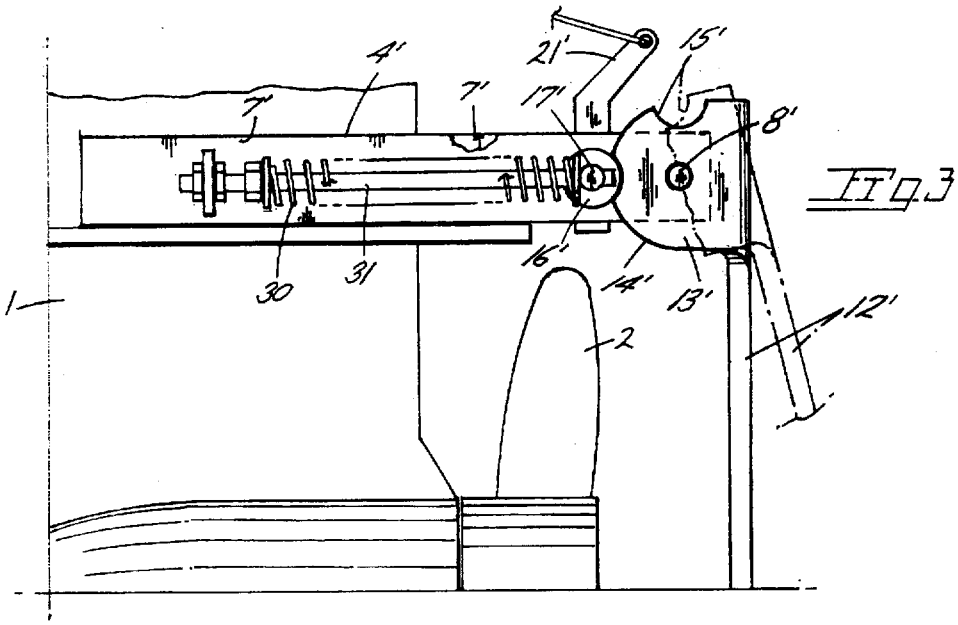
FIG. 3
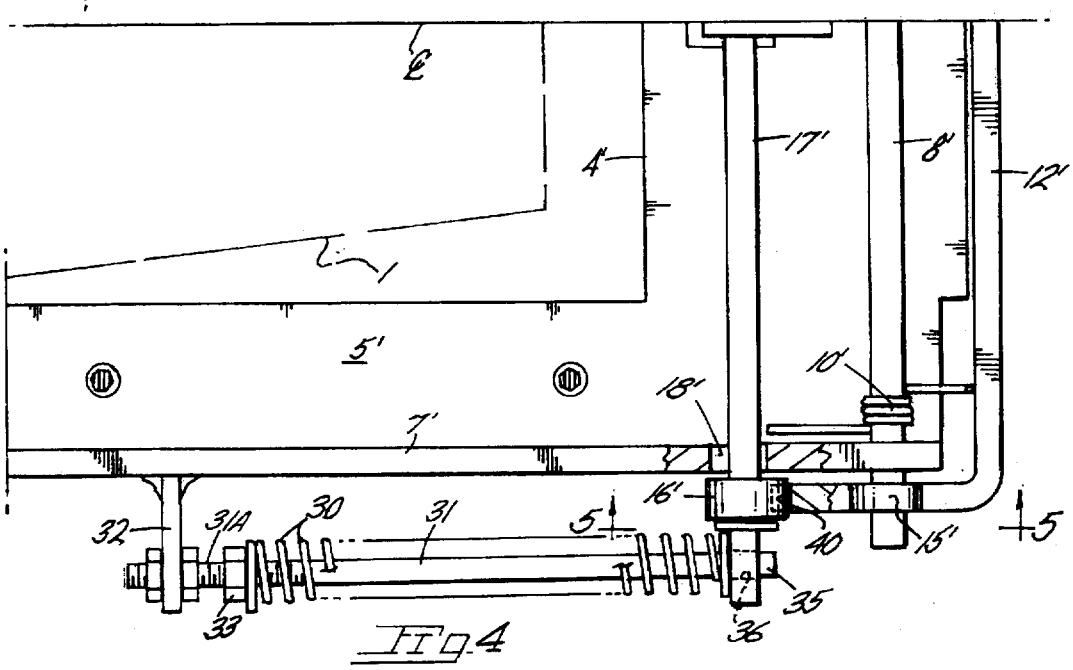
FIG. 4
FIG. 5
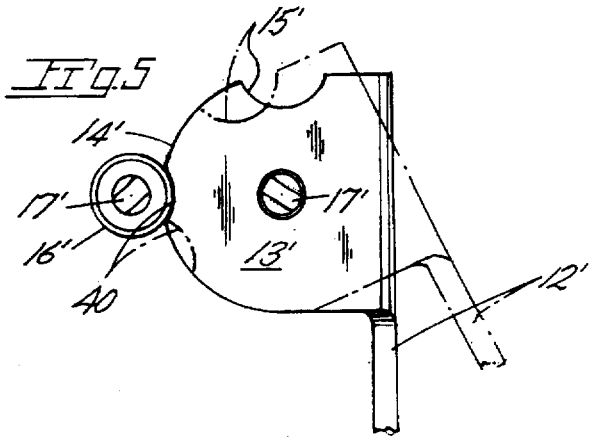

TROLLING PLATE

BACKGROUND OF THE INVENTION

This application is a continuation-in-part of application Ser. No. 08/630,512 filed Apr. 10, 1996 by the present inventor and now abandoned.

The present invention pertains generally to structures for use in conjunciton with boat propulsion units to disrupt the discharge flow of such units to reduce propellor efficiency and hence boat speed. Such units are generally termed trolling plates in the trade, which are in wide use for reducing boat speed to that conducive to the use of trolled lures which would otherwise not be possible because of engine size.

A problem encountered by known trolling plate designs is the locking of trolling plates in a down position in the path of water discharged by a propulsion unit. In such a position a trolling plate may be damaged by an increase in engine speed which results in bending or breaking the trolling plate. Provision is made for unlocking of such trolling plates which permits troller plate retraction in response to increased backwash from the propulsion unit. As the trolling plate is removed from the view of the boat operator it is not uncommon for engine speed to be increased with the trolling plate inadvertently locked in the down position and resulting in damage to the plate as above noted. U.S. Pat. No. 3,965,838 issued to Uht shows such a trolling plate which locks in the down position.

U.S. Pat. No. 2,719,503 discloses a trolling plate assembly attached to the lower unit of an outboard motor with tension springs urging the plate to a lowered or operable position with the plate movable to the horizontal by propellor backwash. The problem encountered with the last noted troll plate is the inability to lock same in a raised, operative position which prevents maneuvering of a boat at slow speeds, as for example, when docking or loading of a boat on a trailer.

SUMMARY OF THE PRESENT INVENTION

The present invention is embodied within the trolling plate structure utilizing a follower element in spring biased engagement with a curved track formed on the trolling plate which permits plate retraction by the backwash of a propulsion unit and subsequent retention of the trolling plate in a raised, horizontal position until selective deployment.

The trolling plate structure of the present concern includes a plate having a pair of tracks or guideways thereon along and on which a pair of followers ride during plate movement. Upon an increase in backwash against the trolling plate, trolling plate movement will occur to allow an increase in trolling speed and directional control. With a still further increase in engine speed and backwash the followers will seat in their respective recesses in the trolling plate coincident with the plate reaching a raised, inoperable position. Torsion springs acting on the trolling plate bias same to a downward, deployed position upon follower displacement out of the recesses, whereupon springs drive the plate to an operable position. From the foregoing it will be understood that the trolling plate may be retracted and held in place upon a momentary increase in engine speed with no actuation of a control or lock necessary to allow boat maneuvering at minimal speeds. Sudden acceleration of engine speed at any time results in lifting of the trolling plate to a raised, locked position without damage to the plate. Provision is also made for lowering of the plate by a cable control release.

In a modified form of the invention, followers are spring biased into trolling plate engagement in an adjustable manner to adapt the plate to a wide range of propulsion units. Detents on the trolling plate for follower reception in both vertical and horizontal plate positions with range of imtermediate plate positions being feasible. In instances when sudden throttle movement greatly increases propeller backwash the trolling plate automatically swings to the horizontal as permitted by roller and detent disengagement thereby avoiding trolling plate damage.

BRIEF DESCRIPTION OF THE DRAWINGS

In the drawings:

FIG. 3 is a view similar to FIG. 1 but showing a modified form of the invention;

FIG. 4 is a plan view of FIG. 3 broken away along a fore-and-aft centerline of the trolling plate; and FIG. 5 is a fragmentary side elevational view of the modified form of the invention with the trolling plate in an intermediate broken line position.

DETAILED DESCRIPTION OF THE PREFERRED EMBODIMENTS

Figure 1:
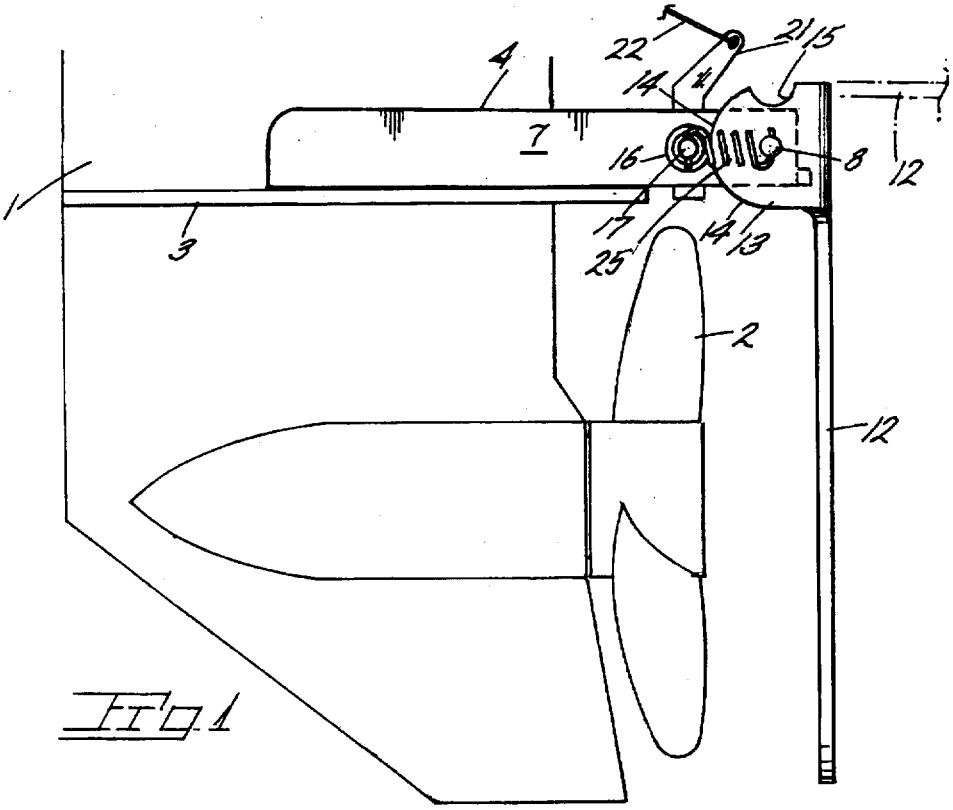
FIG. 1 is a side elevational view of the lower portion of a boat propulsion unit having the present invention in place thereon.
Figure 2:
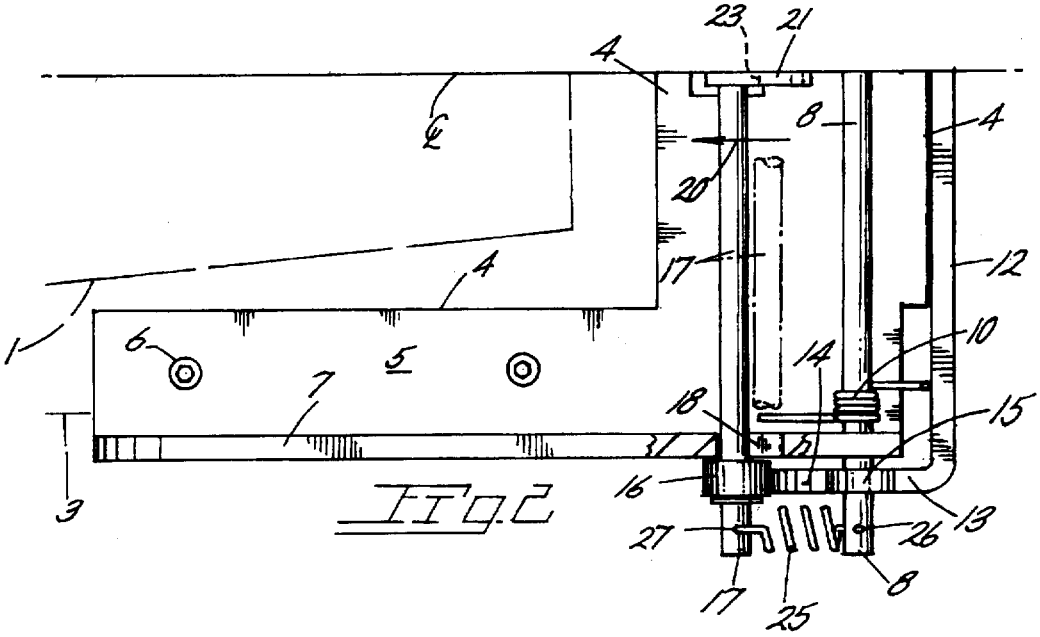
FIG. 2 is a plan view of FIG. 1 broken away along a fore-and-aft center line of the propulsion unit and the present trolling plate assembly.

With continuing attention to the drawings wherein applied reference numerals indicate parts similarly hereinafter identified, the reference numeral 1 indicates a boat propulsion unit with a propellor 2.

With attention now to the present trolling plate assembly, the same includes a bracket 4 which is shown installed on the anti-cavitation plate 3 of the propulsion unit. The bracket includes forwardly extending components 5 each affixed to the anti-cavitation plate as by fasteners 6. Flanges at 7 of the bracket serve to reinforce same and to receive pivot means embodied in the shaft 8 providing an axis about which a later described trolling plate is positionable. Torsion springs at 10 are carried against the ends of shaft 8.

A trolling plate 12 is equipped with ears 13 with each ear apertured to receive shaft 8 for arcuate travel of the plate about shaft 8. Ears 13 each have a track 14 formed thereon shown as a curved edge with the track terminating at a recess 15 formed in said ear.

For travel along track 14 on each ear are follower means shown including rollers 16 each affixed adjacent the opposite ends of a roller positioning shaft 17 which is positionable laterally within elongate openings 18 formed in each flange 7 of the bracket. Accordingly, rollers 16 of the follower means are displaceable out of engagement with recess 15 of each ear 13. For biasing shaft 17 in the direction of an arrow 20 an arm 21 is positionable in a counterclockwise direction by a control 22 to permit the lever to swing with the fulcrum being the edge 23 of an opening 24 defined by the bracket. Accordingly, and with reference to FIG. 1, counterclockwise movement of lever 21 about shaft 17 imparts forward displacement to shaft 17 per arrow 20 for disengagement of rollers 16 from recesses 15 to permit torsion springs 10 to drive trolling plate 12 to an upright position.

Spiral extension springs 25 include hooked end segments 26 and 27 coupled to the ends of shafts 8 and 17 to bias shaft 17 and roller 16 thereon toward engagement with track 14 and recess 15.

In operation, with the trolling plate unlocked and in the spring biased down position, trolling speeds are attainable. At the end of a trolling period, acceleration of the engine raises the trolling plate for automatic locking in the raised position. At slow speeds the watercraft may be maneuvered by momentarily accelerating engine speed to the extent trolling plate 12, if down, is positioned upward by the momentarily increased discharge flow. Followers 16 will seat in recesses 15 to hold the plate in the horizontal position.

Torsion springs 10 have a rate sufficient to confine trolling plate 12 in the operable or down position shown in FIG. 1 against propulsion unit backwash at low or trolling engine speeds. At increased engine speeds, propulsion unit discharge is such as to lift plate 12 against the action of springs 10 without risk of damage to or destruction of the plate as currently occurs with other trolling plates of the type which lock in the down position.

The present trolling plate assembly may be readily adapted for motors of different horsepower by the selection of torsion springs 10 of greater or lesser rates.

The modified or best mode of the present trolling plate is shown in FIGS. 3–5 wherein structure analogous to that earlier described is indicated by prime reference numerals corresponding to the above base reference numerals. While it will be understood that the present trolling plate is broken away along a fore and aft centerline at CL for purposes of illustration, and that the unseen half of the trolling plate assembly would be a mirror image of FIG. 4.

Follower means includes a roller 16' carried at each end of shaft 17' which in turn is received within elongate aperature as at 18' in flanges 7'. For biasing shaft 17' and follower 16' into plate retentive engagement with curved track 14' and a recess 40 of the plate ear 13' a compression spring indicated at 30 is provided in place on shaft 31 carried by flange 32. At least a portion of the shaft is threaded at 31A to receive an adjustment element 33 which bears upon one end of a compression spring 30. A shaft end segment 35 extends through a bore 36 in shaft 17'. Compression spring 30 urges shaft 17' and specifically rollers 16' thereon toward ear edge or track 14'. Adjustment element 33 may be a traveler nut to enable the loading or biasing of rollers 16' to be variable to adapt the trolling plate for use with a range of propulsion units. Downward travel of trolling plate 12' about shaft 8' in response to torsion spring 10' is opposed by the variable resistence of follower 16' in biased, frictional engagement with plate ears 13'. The arcuate edge or track 14' of ear 13' defines a shallow detent at 40 which receives a chordal segment of follower 16' for retention of trolling plate 12' in the vertical at idle and low boat speeds. Recess 15' however retains, in conjunction with follower 16', trolling plate 12' at or near the horizontal whereat the plate avoids interference with propellor backwash allowing higher boat speeds.

In a typical operation, when plate 12' is upright, incremental throttle advancement gradually increases propellor backwash to partially overcome the action of torsion springs 10 unseat rollers 16' and allow plate 12' to move to an inclined trailing position for somewhat greater trolling speed. For example, increased backwash has positioned trolling plate 12' to the rearwardly trailing, broken line position whereat increased propellor efficiency results in increased boat speed and maneuverability. The resistance of followers 16' to upward rotation of plate 12', in conjunction with torsion springs 10, counteracts to render plate 12' being in a state of equilibrium. Plate 12 is protected against bending or breaking by sudden throttle movement and increased backwash as, in such instances, the plate automatically raises toward the horizontal as rollers 16 are displaced by plate ear edges partially defining recesses 40.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A trolling palte assembly for installation on a boat propulsion unit, said plate assembly comprising, a bracket attachable to the propulsion unit, a trolling plate structure, pivot means coupling said plate structure to said bracket permitting the plate structure to move to an upright positon to disrupt backwash from the propulsion unit, spring means acting on said plate structure to urge same to the upright position, said plate structure having ears thereon each having a curved track and a recess therein, follower means including rollers separately entrained on each of said tracks for travel therealong toward said recess during plate structure travel about said pivot means between the upright position and a raised horizontal position, means biasing each of said rollers toward said tracks and into said recess to lock the trolling plate in a horizontal position, and positioning means for displacing said rollers away from each said recess to permit upright positioning of the plate structure by said spring means.

2. The trolling plate assembly claimed in claim 1 wherein said recess is arcuate.

3. The trolling plate assembly claimed in claim 2 wherein said spring means and said means biasing each of said rollers retain the trolling plate structure in an upright position against the backwash of the propulsion unit when operated at boat trolling speeds.

4. The trolling plate assembly claimed in claim 1 wherein each said track is continuous and terminates at said recess.

5. The trolling plate assembly claimed in claim 1 wherein said means biasing said follower means includes a shaft carrying said rollers and adapted for movement toward and away from the track on each of said ears.

6. The trolling plate assembly claimed in claim 5 wherein said means biasing said follower means additionally includes a resilient member acting on said shaft and an adjustable element engaging said resilient member enabling selective loading of said rollers.

7. The trolling plate assembly claimed in claim 6 wherein each of said ears defines a secondary detent for roller engagement each secondary detent of a shape to engage a chordal portion of the roller when said trolling plate structure is in the upright position, backwash from the propulsion unit, in excess of that associated with boat trolling speeds, acting to overcome said spring means and to dislodge each of said rollers from the secondary detent of each of said ears to permit at least partial retraction of the trolling plate structure about said pivot means thereby avoiding damage to the plate structure.

8. A trolling plate assembly for installation on a boat propulsion unit, said trolling plate assembly comprising, a bracket attachable to the propulsion unit, a trolling plate structure, pivot means coupling said plate structure to said bracket permitting the plate structure to swing from a raised generally horizontal position to an upright position to disrupt backwash from the propulsion unit, spring means acting on the plate structure to urge same to the upright position, said plate structure having ears thereon each having a track thereon and a first recess located along said track, follower means including rollers separately entrained on each of said tracks for travel therealong during plate structure travel about said pivot means between the upright and generally horizontal positions, means biasing each of said rollers toward said tracks and into said first recess to lock the plate structure in the substantially horizontal position, positioning means for displacing each of said rollers out of their respective first recesses to permit upright positioning of the plate structure by said spring means, and each of said ears defining a secondary detent for roller engagement, each secondary detent of a shape to engage a chordal portion of the roller when said trolling plate structure is in the upright position, backwash from the propulsion unit, in excess of that occuring at boat trolling speeds, acting to overcome said spring means and to dislodge each of said rollers from the secondary detent of each of said ears to permit at least partial retraction of the trolling plate structure about said pivot means thereby avoiding damage to the plate structure.

9. The trolling plate assembly claimed in claim 8 wherein each said secondary detent is arcuate.

10. The trolling plate assembly claimed in claim 8 wherein said means biasing each of said rollers includes a shaft carrying each of said rollers and adapted for movement toward and away from the track on each of said ears, a resilient member acting on said shaft, an adjustable element engaging said resilient member enabling selective biasing of the rollers toward the tracks.

* * * * *